US008550663B2

(12) United States Patent
Tong

(10) Patent No.: US 8,550,663 B2
(45) Date of Patent: Oct. 8, 2013

(54) INFLATABLE SYSTEM CARRYING A LIGHT STRING SYSTEM

(75) Inventor: Ricky Tong, Hong Kong (CN)

(73) Assignee: Polygroup Macau Limited (BVI), Tortola (VG)

( * ) Notice: Subject to any disclaimer, the term of this patent is extended or adjusted under 35 U.S.C. 154(b) by 56 days.

(21) Appl. No.: 13/011,329

(22) Filed: Jan. 21, 2011

(65) Prior Publication Data

US 2012/0020090 A1 Jan. 26, 2012

Related U.S. Application Data

(60) Provisional application No. 61/296,938, filed on Jan. 21, 2010.

(51) Int. Cl.
*F21S 4/00* (2006.01)
*F21V 3/00* (2006.01)

(52) U.S. Cl.
USPC ..... 362/249.16; 362/249.14; 362/311.13

(58) Field of Classification Search
USPC ..... 362/124, 240.09, 249.14, 249.16, 362/311.13, 352, 806, 808
See application file for complete search history.

(56) References Cited

U.S. PATENT DOCUMENTS

| | | | | |
|---|---|---|---|---|
| 5,102,364 | A * | 4/1992 | Kubiatowicz | 446/220 |
| 5,816,686 | A * | 10/1998 | Wang et al. | 362/653 |
| 5,947,581 | A * | 9/1999 | Schrimmer et al. | 362/96 |
| 6,371,638 | B1 * | 4/2002 | Zingale et al. | 362/565 |
| 7,198,380 | B1 * | 4/2007 | Eatmon-Kral | 362/101 |
| 7,320,529 | B2 * | 1/2008 | Goh et al. | 362/96 |
| 7,344,267 | B2 * | 3/2008 | Carito | 362/189 |
| 2002/0159256 | A1 * | 10/2002 | Chen | 362/226 |
| 2006/0141898 | A1 * | 6/2006 | Petell | 446/220 |
| 2006/0291217 | A1 * | 12/2006 | Vanderschuit | 362/363 |
| 2007/0247874 | A1 * | 10/2007 | Yang | 362/654 |
| 2008/0032588 | A1 * | 2/2008 | Sun | 446/220 |
| 2008/0032589 | A1 * | 2/2008 | Sun | 446/220 |
| 2008/0032590 | A1 * | 2/2008 | Sun | 446/220 |
| 2008/0242190 | A1 * | 10/2008 | Hofer et al. | 446/220 |
| 2008/0266860 | A1 * | 10/2008 | Marcinkewicz et al. | 362/253 |
| 2009/0053946 | A1 * | 2/2009 | Ashby | 441/36 |
| 2009/0191787 | A1 * | 7/2009 | Rubinstein | 446/220 |
| 2009/0296397 | A1 * | 12/2009 | Gibboney, Jr. | 362/249.16 |
| 2009/0303704 | A1 * | 12/2009 | Schrimmer | 362/184 |

* cited by examiner

*Primary Examiner* — David J Makiya
*Assistant Examiner* — Bryon T Gyllstrom
(74) *Attorney, Agent, or Firm* — Benjamin C. Wiles, Esq.; Ryan A. Schneider, Esq.; Troutman Sanders LLP

(57) ABSTRACT

A decorative system includes an inflatable bladder assembly, a light string system, and a covering. The inflatable bladder assembly includes a bladder, which includes a seal or passage for dispensing and removing media to inflate the bladder. The interior of the bladder is adapted to receive and hold media inserted therein. When the bladder is inflated, it provides a desired, decorative shape. When the bladder is not inflated, it provides a foldable profile that has a low weight and is relatively easy to package and/or ship. The light string system includes a plurality of lamp systems tied together with a plurality of conductive wires. Each lamp system includes a light assembly and a socket assembly. Each lamp system can be secured to the exterior of the bladder by an attachment assembly. The covering can cover the inflated bladder to provide additional shape and structure to the decorative system.

13 Claims, 4 Drawing Sheets

INFLATABLE SYSTEM CARRYING A LIGHT STRING SYSTEM

CROSS REFERENCE TO RELATED APPLICATION

This application claims benefit, under 35 U.S.C. §119(e), of U.S. Provisional Application Ser. No. 61/296,938, filed 21 Jan. 2010, the entire contents and substance of which are hereby incorporated by reference.

FIELD OF INVENTION

The presently disclosed subject matter relates to inflatable structures.

BACKGROUND

Ornamental and decorative devices are commonly used to decorate residential and commercial buildings in accordance with a desired theme. For instance, during holiday seasons, buildings can be decorated with temporary decorations depicting snowmen, polar bears, Santa Claus, reindeer, and the like. Alternatively, buildings can be decorated with temporary white or multi-colored lights to promote a festive holiday atmosphere. Temporary decorations can also be used during other selected times of the year to accommodate a desired temporary theme. Alternatively, permanent decorations can be used for themes other than holiday or temporary themes. For instance, businesses can use colored lights to draw attention to services or products, or sporting events can use various ball-shaped decorations (e.g., a baseball) to promote games.

SUMMARY

Briefly described, embodiments of the presently disclosed subject matter relate to a decorative system. The decorative system can include an inflatable bladder assembly, a light string system, and a covering. The inflatable bladder assembly can include a bladder which typically includes a seal and/or a passage for dispensing and removing media to inflate the bladder. The interior of the bladder can be adapted to receive and hold media inserted therein. When the bladder is inflated, it provides a desired, decorative shape. When the bladder is not inflated, it preferably provides a foldable profile that has a low weight and is relatively easy to package and/or ship. The light string system can include a plurality of lamp systems tied together with a plurality of conductive wires. Each lamp system includes a light assembly and a socket assembly. Each lamp system can be secured to the exterior of the bladder by an attachment assembly. The covering can cover the inflated bladder and cover the light string system, to provide additional shape and structure to the decorative system.

In one non-limiting example, the system is an inflatable decorative system having an inflatable bladder assembly with an inflatable bladder having an aperture for dispensing gaseous media into the bladder to inflate the bladder. The system of the present example can further have a light string assembly comprising a plurality of lamp systems in electrical communication. In some examples, it can be desirable or necessary to provide a way for the lights in the light string assembly to remain lit despite the remove of one or more of the lights. In that example, a bypass mechanism can be used to divert the flow of current through the bypass mechanism when the light source is removed. In this example, the lamp systems can be constructed of a light source, a base, and a bypass activating system extending downwardly from the base. The socket assembly can be dimensioned to receive via insertion at least a portion of the base of the light assembly.

To provide a way to maintain current flow, a bypass mechanism can be positioned within the socket assembly, the bypass mechanism comprising a conductive element having a pair of arms, wherein one or both of the arms of the conductive element are moveable between a first and second position. The bypass activating system causes one or both of the arms to move to a first position to cause current flow through the light assembly upon insertion of the bypass activating system into the socket assembly and wherein upon removal of the bypass activating system from the socket assembly the current flow is bypassed around the light assembly and through the socket assembly.

In one example, the presently disclosed subject matter is an inflatable decoration system having a shape associated with a particular festive occasion with an inflatable bladder assembly comprising an inflatable bladder having an aperture for dispensing media into the bladder to inflate the bladder. The decoration system also has a light string assembly and a covering to a least partially cover the inflatable bladder assembly.

In another example, the presently disclosed subject matter is an inflatable decorative system having an inflatable bladder assembly comprising an inflatable bladder having an aperture for dispensing gaseous media into the bladder to inflate the bladder and a covering to a least partially cover the inflatable bladder assembly. The decorative system also has a light string assembly comprising a plurality of lamp systems in electrical communication. The lamp systems have a light assembly comprised of a light source, a base; and a bypass activating system extending downwardly from the base. The light string assembly also has a socket assembly dimensioned to receive via insertion at least a portion of the base of the light assembly. To maintain power if a light source is removed from the base, the light string assembly can also have a bypass mechanism positioned within the socket assembly comprising a conductive element having a pair of arms, wherein one or both of the arms of the conductive element are moveable between a first and second position. In the present example, the bypass activating system causes one or both of the arms to move to a first position to cause current flow through the light assembly upon insertion of the bypass activating system into the socket assembly. Upon removal of the bypass activating system from the socket assembly the current flow is bypassed around the light assembly and through the socket assembly.

The foregoing summarizes only a few aspects of the presently disclosed subject matter and is not intended to be reflective of the full scope of the presently disclosed subject matter as claimed. Additional features and advantages of the presently disclosed subject matter are set forth in the following description, can be apparent from the description, or can be learned by practicing the presently disclosed subject matter. Moreover, both the foregoing summary and following detailed description are exemplary and explanatory and are intended to provide further explanation of the presently disclosed subject matter as claimed.

BRIEF DESCRIPTION OF THE DRAWINGS

The accompanying drawings, which are incorporated in and constitute a part of this specification, illustrate multiple embodiments of the presently disclosed subject matter and, together with the description, serve to explain the principles of the presently disclosed subject matter; and, furthermore, are not intended in any manner to limit the scope of the presently disclosed subject matter

In the drawings, the same reference numbers identify identical or substantially similar elements or acts. Any headings provided herein are for convenience only and do not necessarily affect the scope or meaning of the claimed presently disclosed subject matter.

DETAILED DESCRIPTION

Figure 1:
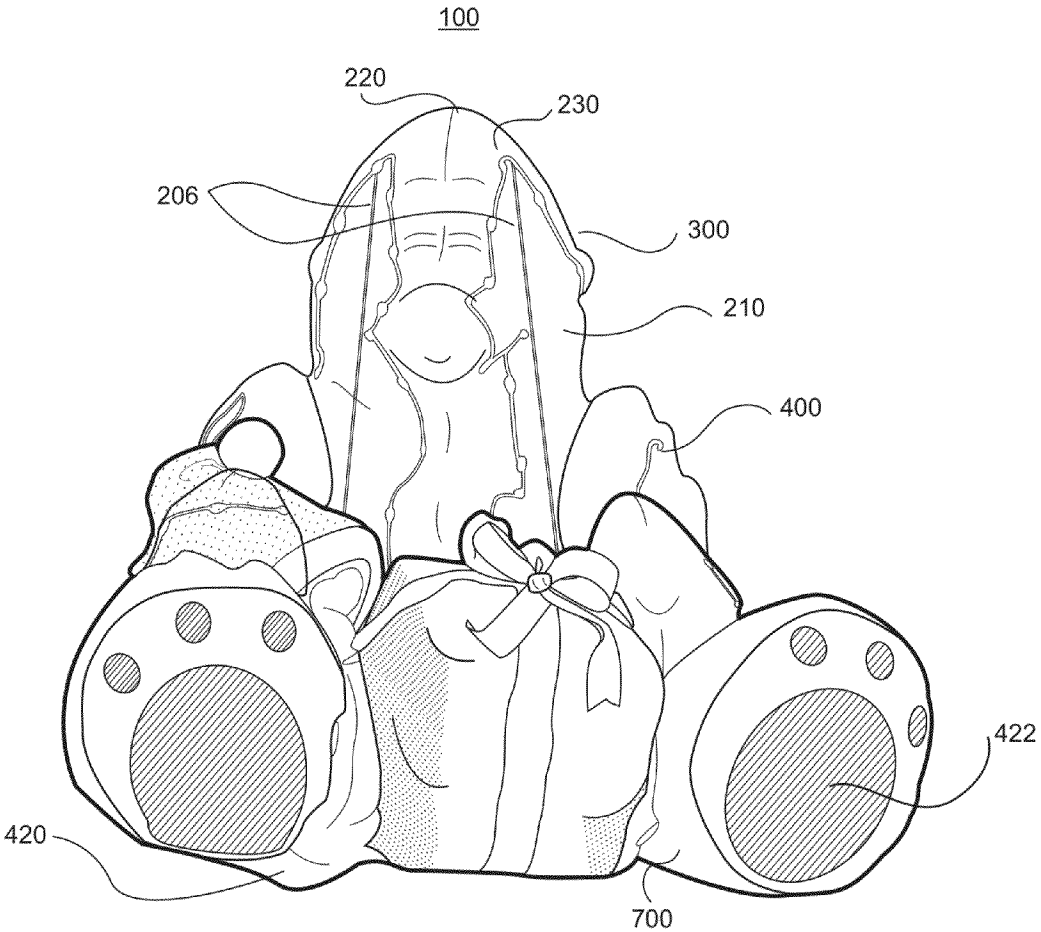
FIG. 1 is a front, perspective illustration of an inflatable system in accordance with an exemplary embodiment of the presently disclosed subject matter.

The subject matter of the various embodiments is described with specificity to meet statutory requirements. However, the description itself is not intended to limit the scope of this patent. Rather, it has been contemplated that the claimed subject matter might also be embodied in other ways, to include different steps or elements similar to the ones described in this document, in conjunction with other present or future technologies. Moreover, although the term "step" may be used herein to connote different aspects of methods employed, the term should not be interpreted as implying any particular order among or between various steps herein disclosed unless and except when the order of individual steps is explicitly required. It should be understood that the explanations illustrating data or signal flows are only exemplary. The following description is illustrative and non-limiting to any one aspect.

It should also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. Also, in describing preferred embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" one particular value and/or to "about" or "approximately" another particular value. When such a range is expressed, other exemplary embodiments include from the one particular value and/or to the other particular value. The terms "comprising" or "containing" or "including" mean that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

To facilitate an understanding of the principles and features of the presently disclosed subject matter, embodiments are explained hereinafter with reference to implementation in an illustrative embodiment. In particular, embodiments of the presently disclosed subject matter are described in the context of being a decorative inflatable system.

Embodiments of the presently disclosed subject matter, however, are not limited to use as a decorative inflatable system. Rather, embodiments of the presently disclosed subject matter can be used as a decorative bladder as needed or desired. For example, although embodiments of the presently disclosed subject matter are described as a bladder, it will be understood that the disclosed inflatable system can be used with many designs and can carry various materials needed to enhance the overall design.

The materials described hereinafter as making up the various elements of the presently disclosed subject matter are intended to be illustrative and not restrictive. Many suitable materials that would perform the same or a similar function as the materials described herein are intended to be embraced within the scope of the presently disclosed subject matter. Such other materials not described herein can include, but are not limited to, materials that are developed after the time of the development of the presently disclosed subject matter, for example.

Figure 2:
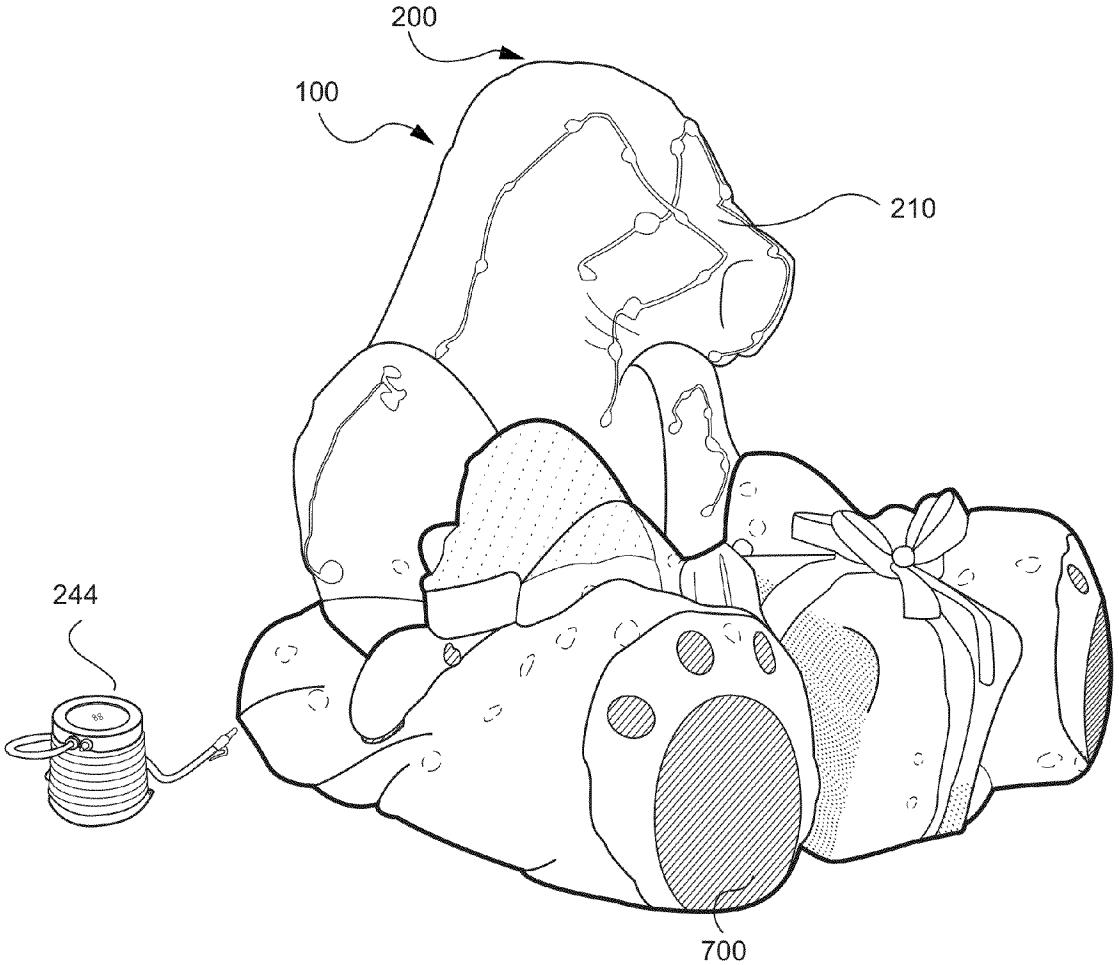
FIG. 2 is a side, perspective illustration of an inflatable system in accordance with an exemplary embodiment of the presently disclosed subject matter.
Figure 3:
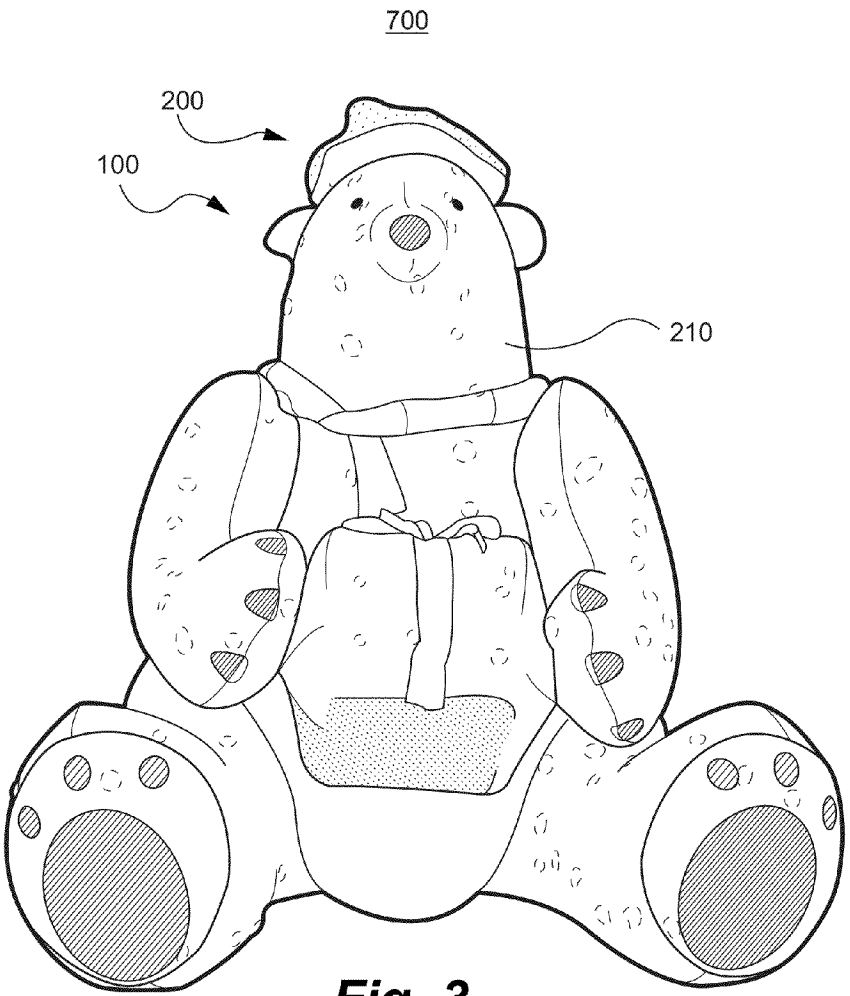
FIG. 3 is another front, perspective illustration of an inflatable system in accordance with an exemplary embodiment of the presently disclosed subject matter.

As illustrated in FIGS. 1-3, an inflated polar bear holding a gift box can be an exemplary decorative system for a holiday, including for example Christmas. The following is a list, not to be exhaustive but only illustrative, of potential decorative system designs: gifts, candy cane(s), Santa Claus, snowman, polar bear, reindeer, Christmas tree (s), North Pole, elf, manger, cross, ornament, sled, holly, bells, stockings, star, candles, sack of gifts, wreath, mistletoe, and the like, as well as combinations thereof.

Christmas, however, is not the only holiday or occasion for which the decorative system can be designed or used to acknowledge. The decorative system can entail designs for celebrating other holidays or occasions. For instance, the holiday of Halloween can include decorative systems, including, for example and not limitation, black cat(s), ghost(s), witch(es), bat(s), pumpkin(s), and the like, as well as combinations thereof. The holiday of Thanksgiving can include decorative systems, including, for example and not limitation, turkey, cornucopia, pilgrims, Indians, and the like, as well as combinations thereof. Still other events, such as Independence Day, birthdays, and Easter can provide decorative systems. Other examples can include flags, sports memorabilia, and other decorations capable of three-dimensional views. The decorative system can be manufactured for use both indoors and outdoors. The decorative system can include many types, shapes, and sized decorations.

Manufacturing the decorative system with flexible materials can also enable the system to conform to the desired shape of the design. In other words, because the decorative system is flexible and inflatable—it can be inflated, or deflated, as needed to conform to the desired design.

In an exemplary embodiment, the decorative system can be filled with air. This can enable it to be inflated and deflated using, for example and not by way of limitation, a standard air mattress inflator/deflator. Relatively easy portability of the decorative system can be desirable. The decorative system can be inflated and frictionally held in place by a stabilization member such as a stake or by one or more tie-downs 420 used to secure the decorative system to a surface such as the ground or a floor. The stabilization member can be particularly useful is the decorative system is place outside, exposing the decorative system to wind.

There are many benefits of the decorative system, including but not limited to reducing bulky packaging of decorative systems, reducing weight of decorative systems for ease of transport, reducing shipping weight and size of decorative systems, reducing cost of manufacturing of decorative systems, reducing shipping costs of decorative systems, ease of assembly, relatively easy of disassembly, improvement in appearance, and the like.

Referring now to the figures, FIGS. 1-3 illustrate an exemplary decorative system in accordance with an exemplary embodiment of the presently disclosed subject matter. In an exemplary and non-limiting embodiment, the decorative system 100 of the embodiments of the presently disclosed subject matter includes an inflatable bladder assembly 200, a light string system 300, and a covering 700. In some examples, the inflatable bladder assembly 200 includes a bladder 210, which includes a seal 422 for dispensing and removing media to inflate the bladder 210. In that example, the interior of the bladder 210 is adapted to receive and hold media inserted or dispensed therein. Devices used to dispense media can include, but are not limited to, an electrical or mechanical air pump, such as manual pump 244 shown in FIG. 2, or an air passageway for a person to expel air into the bladder 210 to inflate the bladder 210.

When the bladder 210 is inflated, it typically provides a desired, decorative shape, for example and not limitation those decorative shapes mentioned above. When the bladder 210 is not inflated, it preferably provides a foldable profile that has a low weight and is relatively easy to package and/or ship. The light string system 300 includes a plurality of lamp systems 400 tied together with a plurality of conductive wires. Each lamp system 400 includes a light assembly 500 and a socket assembly 600, as described below with regards to FIG. 4. Each lamp system 400 can be secured to the exterior of the bladder 210 by an attachment assembly. The covering 700 can cover the inflated bladder 210, and cover the light string system 300, to provide additional shape and structure to the decorative system 100. The bladder 210 of the inflatable bladder assembly 200 can be made up of various polymers. In an exemplary embodiment, the bladder 210 is made of plastic.

The bladder 210 can be inflated when media is dispensed into the interior of the bladder 210. For example, the bladder 210 can be a sealed plastic container that includes a passage or seal. The passage provides a conduit for gaseous media to enter the bladder for inflation and to exit the bladder for deflation. As discussed above, for example and not limitation, the bladder can be inflated with a conventional air pressure device, such as pump 244 adapted to push air into the passage and thus fill the interior of the bladder for inflating (e.g., an air mattress inflator/deflator). Media other than air can be used to fill the bladder. For example, in some examples, nitrogen or helium, or combinations thereof, can be used. When inflated, the bladder 210 can make the shape of the decoration desired. In some cases, the media can be used to inflate the bladder 104 for a predetermined amount of time. For example, in cases in which helium is used as the media, it may be expected that the bladder 104 may only maintain the helium for a short time whereas if the media is water, the predetermined time may be longer.

The bladder 210 can be outfitted with one or more support rods 206 that can be placed along the perimeter of the bladder for supporting the structure or to help form the bladder into a specific shape when at least partially inflated. The support rods 206 can further provide details to the overall design of the bladder 210. The support rods 206 can be disposed internally or externally to bladder 210 and, in some examples, can be removable.

The perimeter of the bladder can include at least one attachment assembly 220. The attachment assembly 220 can be a mechanical device to support and thus carry the light string system 300. In an exemplary embodiment, for each lamp system 400 of the light string system carried by the bladder 210, an attachment assembly 220 can receive a portion of and thus carry the lamp system 400. This secures the lamp system 400 to the bladder 210, and enables the entire light string system 300 to be carried by the bladder 210.

In an exemplary embodiment, the attachment assembly 220 can include a support member 230 to for the light string system 300 to be carried by the bladder 210. Lamp system 400 can be positioned in various positions relative to the perimeter of the bladder 210, and held by the support member 230 of the attachment assembly 220. In an exemplary embodiment, the lamp system 400 can be positioned parallel to the outer surface of the bladder 210. In another embodiment, the lamp system 400 can positioned normal to the outer surface of the bladder 210. Depending on the shape, color, and orientation of the outer of the bladder, the position of the lamp system relative to the outer of the bladder can vary. It can be desired for the lamp system to provide as much reflective light as possible.

In an exemplary embodiment, the lamp system (described more fully below) can be outfitted with an extending member that can lock to the outer of the bladder 210. For example, an extending member of the lamp system 400 can be locked to an aperture or grip, which is part of the outer of the bladder 210.

In an exemplary embodiment, the extending member of the lamp system can receive and/or grip a pair of wires between lamp systems. This receipt or grip can lock the lamp system 400 (either the base of the light assembly and/or the socket of the socket assembly) to the outer of the bladder 210. When the wires are received by a grip, the lamp system 400 can be further secured to the outer of the bladder 210. In exemplary embodiments, the light string system 300 can be positioned within the bladder or carried by the outside, or exterior, of the bladder 210.

To provide a more realistic decorative system 100, the inflatable bladder assembly 200 carrying the light string system 300 can be covered by the covering 700. The covering 700 can be secured over the inflatable bladder assembly 200 as well as over the light string system 300.

There are various methods, considered within the scope of the presently disclosed subject matter, of placing the covering 700 over the inflatable bladder assembly 200. In an exemplary embodiment, the bladder 210 can be manufactured and dressed with the covering 700. Then, when a user inflates the inflatable bladder assembly 200, the covering 700 automatically rises with the inflation of the bladder 210. In an exemplary embodiment, the inflatable bladder assembly 200 can be partially inflated, and then dressed with the covering 700. That is, the inflatable bladder assembly 200 can be partially inflated, such that the covering 700 fits over a significant portion of the bladder 210, then the covering 700 can be pulled up and over the inflatable bladder assembly 200, and ultimately the bladder 210 can be fully inflated. In another exemplary embodiment, the covering 700 can be placed over the inflatable bladder assembly 200 after the bladder 200 is fully inflated. Here, the covering 700 can be stretched and placed over the bladder 210. In an exemplary embodiment, the light string system 300 can be placed over the covering 700.

Figure 4:
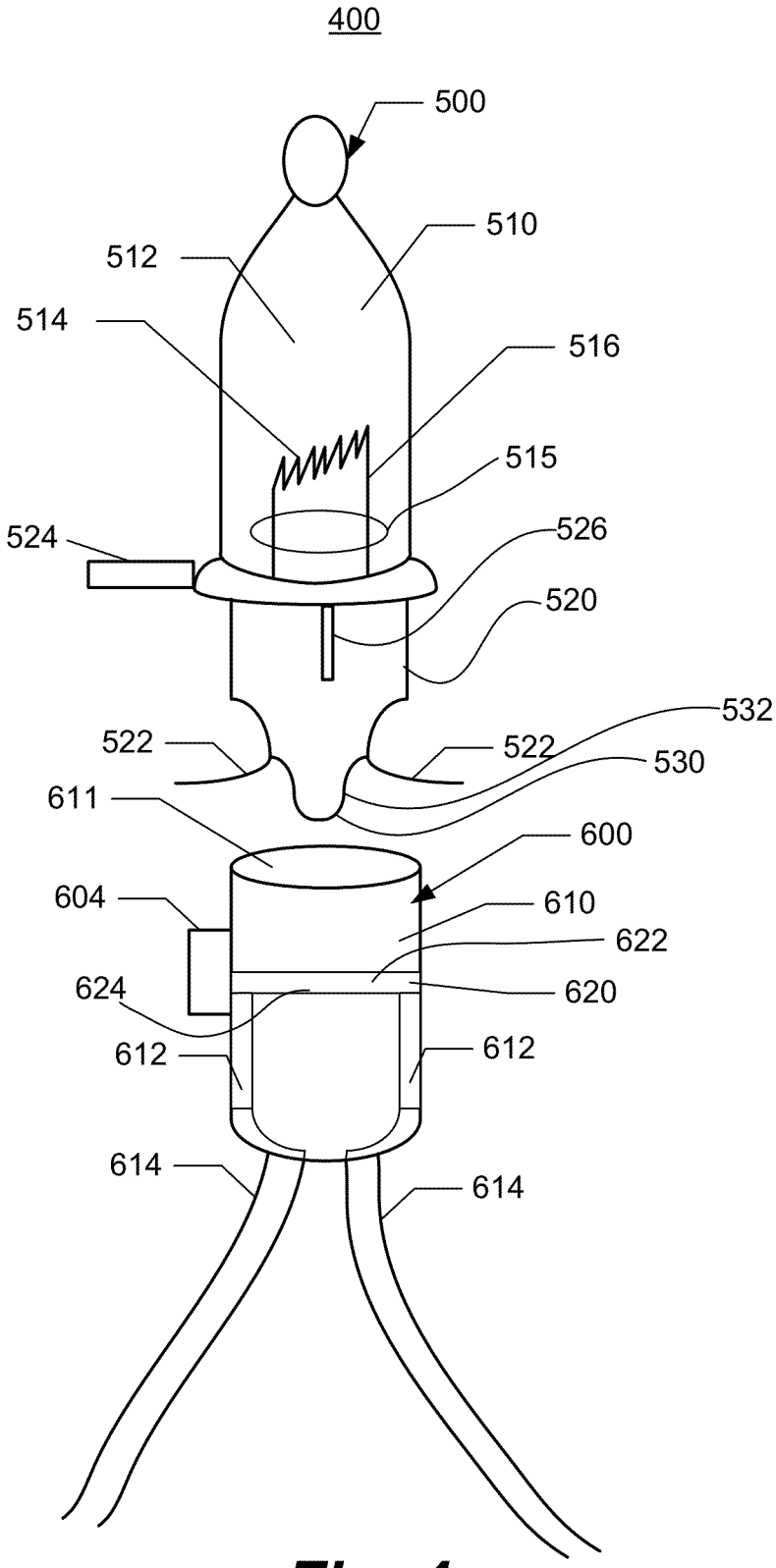
FIG. 4 is a partial cross-sectional illustration of a lamp system of a light string system, in accordance with an exemplary embodiment of the presently disclosed subject matter.

FIG. 4 illustrates a partial cross-sectional view of an exemplary and non-limiting embodiment of a lamp system for use in a light string system, such as light string system 300 of FIGS. 1-3. In one example, a conventional light string system comprises a plurality of lamp systems 400 electrically connected in series, wherein each lamp system 400 includes the light assembly 500 and the socket assembly 600. The lamp system 400 can be a conventional lamp system or can be a shunted lamp system. A shunted lamp system is adapted to provide illumination to an electrical series light string system when a light assembly 500 is missing from the socket assembly 600, improperly seated from the socket assembly 600, or broken. In the shunted lamp system, a bypass activating system 530 can strike a bypass mechanism 620, when the light assembly is inserted into the socket assembly. On the other hand, when the light assembly is missing from the socket assembly 600, improperly seated from the socket assembly 600, or broken, the bypass mechanism can permit electrical energy or current to flow across the socket assembly 600 to the next lamp system in the light string system, which is generally described below.

In exemplary embodiments of the presently disclosed subject matter, the light assembly 500 can comprise a light source 510 and a base 520 in communication with the light source 510. In addition, the light assembly 500 can include the bypass activating system 530. The socket assembly 600 can comprise a socket 610 adapted to receive the light assembly 500. In addition, the socket assembly 600 can include the bypass mechanism 620 having a first position and a second position.

The light assembly 500 includes the light source 510, which provides light when energized. The light source 510 can be many types of light sources, including a light bulb, light emitting diode (LED), incandescent lamp, halogen lamp, fluorescent lamp, or the like. For example, the light source 510 can be a light bulb, as shown in FIG. 4. The light assembly 500 and, more typically, the light bulb 510 of the light assembly 500 has a shunt device 515 to keep the light string system illuminated, even if the bulb 510 burns out or fails.

The light source 510 can include a globe 512 and a filament 514. The globe 512 is in communication with, and terminates at, the base 520. The globe 512 can be made of conventional translucent or transparent material such as plastic, glass, and the like. The globe 512 includes a hollow interior enabling protection of the filament 514.

When charged with energy, the filament 514 can illuminate the light source 510. A pair of conductors 516 can be in electrical communication with the filament 514. The conductors 516 enable energy into the light source 510 to illuminate the filament 514 and, as a result, the light source 510. The conductors 516 extend down through the base 520, wherein the conductors 516 can be integral with and/or in communication with a pair of lead wires 522 external the base 520. The lead wires 522 can be a pair of wires extending through a bottom of the base 520. A portion of the lead wires 522 that extends through the base can wrap around the base 520, for example, further extending upwardly in the direction of globe 512 adjacent the base 520.

The light assembly 500 further includes the base 520, which can be integrally formed with the light source 510 or a separate element from the light source 510. The base 520 communicates between the light source 510 and an associated socket 610, complimenting and facilitating the seating of the light assembly 500 into the socket 610. The base 520 can incorporate a least one ridge 526 to ensure a snug fit with the socket 610, preventing accidental disengagement of the light assembly 500 from the socket assembly 600 or ensuring proper seating of the light assembly 500 in the socket assembly 600. Other mechanical means can be used with the base 520 and the socket assembly 600 to ensure a tight fit.

For example, the light assembly 500 can also include a locking assembly to secure the light assembly 500 to the socket assembly 600. The locking assembly can be exterior or designed within the socket assembly 600 to fasten the connection of the light assembly 500 to the socket assembly 600 internally. The locking assembly can be external and can include cooperating light assembly elements 524 and socket assembly element 604. These elements 524 and 604 can be formed as a clasp and a lock to insert the clasp. For example, the base 520 of the light assembly 500 can include the element 524 that extends normal to the base 520 and can define an aperture. On the other end of the locking assembly can be the element 604 of the socket 610 to be inserted into the element 524 of the base 520. As the element 604 of the socket 610 is inserted into the element 524 of the base 520, the locking assembly locks the light assembly 500 to the socket assembly 600. Stringent Underwriters Laboratories (UL) requirements can require that lights and sockets fit tightly together, which can decrease the value of a locking mechanism in the lamp system 400. The improvement in injection molding machines now enables the production of sockets and lamp assemblies that have a tight, snug fit. In an exemplary embodiment, the locking assembly of the lamp system 400 can act as the extending member for locking the lamp system 400, and possibly the entire light string system, to the bladder 210.

In an exemplary embodiment, the bypass activating system 530 of the light assembly 500 can activate and deactivate the bypass mechanism 620 of the socket assembly 600 by moving the bypass mechanism 620 between the first and second positions. The bypass activating system 530 can extend in a downward direction from base 520 of the light assembly 500 to activate the bypass mechanism 620 of the socket assembly 600 upon the proper seating of the light assembly 500 in the socket assembly 600. The bypass activating system 530 can include one or more downwardly extending members. In one embodiment, the bypass activating system 530 can be in a downward "V" shape. Alternatively, the bypass activating system 530 can be one or more extending members 532, or can comprise various other configurations complementary to the configuration of the bypass mechanism 620.

The socket assembly 600 comprises the socket 610 adapted to receive the light assembly 500. The socket 610 defines a cooperatively-shaped aperture 611 to receive at least the base 520 of the light assembly 500. The socket 610 can also be adapted to receive the whole of the bypass activating system 530 of the light assembly 500. The socket 610 can be arranged in many shapes and sizes, but the socket 610 should be of a shape to conveniently receive the light assembly 500.

The socket 610 includes a pair of socket terminals 612. The socket terminals 612 can be located on opposing inner sides of the socket 610. The socket 610 further includes a pair of terminal wires 614 extending to the exterior to allow energy to enter and exit the socket 610. Each socket terminal 612 can be essentially an extension of each respective terminal wire 614. The terminal wire 614 extends through the bottom of the socket 610 to ultimately connect to an electrical source. Therefore, the electrical current is introduced into the socket 610 by one of the terminal wires 614 and conducted either through the bypass mechanism 620, if the bypass mechanism 620 is in the first position, or through lead wires 522 to the filament 514 to illuminate the light bulb 510, if in the second position. Regardless of path, the current can flow to the other of the lamp systems 100 of the light string.

The bypass mechanism 620 of the socket assembly 600 includes a conductive element 622, which rests in the socket 610. The conductive element 622 includes a first position and a second position corresponding to the first and second positions of the bypass mechanism 620. For example and not limitation, the bypass mechanism 620 incorporates the conductive element 622, such that an electric circuit extends from the left terminal wire 614, through the left socket terminal 612 across conductive element 622, and ultimately to the right terminal wire 614 via the right socket terminal 612.

In some embodiments, the conductive element 622 can be a spring mechanism 624. The socket 610 is dimensioned to receive the insertion of the bypass activating system 530, which can force portions of the single spring 624 together, not apart, when the light assembly 500 is inserted into the socket 610. In other words, the bypass activating system 530 can cause the conductive element 622 to spring inwardly, toward the center of the socket 610. The single spring 624 springs apart, not together, when the light assembly 500 is removed from the light socket 610.

When the light assembly 500 is inserted into the socket 610, the bypass activating system 530 can push at least one side of the conductive element 622 down, distal the socket terminal 612 to "open" the circuit across 622. This disables the electrical connection that the bypass mechanism 620 created, and the circuit is closed via the bulb 510, as opposed to the conductive element 622. In an exemplary embodiment, both sides of the conductive element 622 can be disengaged by the bypass activating system 530. The bypass mechanism 620 can be maintained in the socket assembly by grooves/cutouts formed within the socket and/or a holder placed in the socket.

The bypass activating system 530 can have one or more pointed or rounded tips that facilitate disconnecting the bypass mechanism 620 from the socket terminals 612. The bypass activating system 530 disables the physical connection of the bypass mechanism 620, thereby eliminating any electrically conductive path for the electrical current to flow, other than through the inserted light assembly 500.

The bypass mechanism 620 permits the removal of one or more light assemblies 500 of the lamp system 400, while maintaining the lighting of the remaining lights of a light string system. When a light assembly 500 is missing from a socket 610, the bypass mechanism 620 creates a short circuit, and therefore enables current flow to continue to other lamp systems 400 within a light string. Each socket 610 can have a single current carrying bypass mechanism 620, which pushes away from the socket terminal 612 when the bypass activating system 530 engages the bypass mechanism 620, thereby breaking electrical continuity across the bypass mechanism 620. When the base 520 of the light assembly 500 is fully engaged in the socket 610, the lead wires 522 extending from the base 520 will make electrical contact with the socket terminals 612 completing the electrical circuit. When the light assembly 500 is removed, the bypass mechanism 620 again makes contact with the socket terminals 612, maintaining the electrical connection.

The bypass mechanism 620 has at least two positions—a first position and a second position. The first position bypasses energy flow when a light assembly 500 is burnt, missing, or not properly seated in the socket 610. In the first position, the bypass mechanism 620 extends to make contact with the sides of the socket 610, the socket terminals 612. As a result, an electrical circuit is created, or a short circuit is formed. This situation arises when the light assembly 500 is missing from or improperly seated in the socket 610. The second position enables energy to flow through the light source 510 to illuminate it. In the second position, the bypass mechanism 620 is removed from electrical communication from at least one side of the socket 610 (at least one of the socket terminals 612). The electrical circuit through the bypass mechanism 620 is disconnected, or an open circuit is formed. This situation typically arises when a light assembly 500 is fully inserted, and thus properly seated, in the socket 510. For instance, the bypass activating system 530 pushes the bypass mechanism 620 together when the light assembly 500 is being seated in the socket 610; and the bypass mechanism 620 pushes apart when the light source 510 is being removed from the socket 610.

Finally, while the present disclosure has been described in connection with a plurality of exemplary aspects, as illustrated in the various figures and discussed above, it is understood that other similar aspects can be used or modifications and additions can be made to the described aspects for performing the same function of the present disclosure without deviating therefrom. For example, in various aspects of the disclosure, methods and compositions were described according to aspects of the presently disclosed subject matter. However, other equivalent methods or composition to these described aspects are also contemplated by the teachings herein. Therefore, the present disclosure should not be limited to any single aspect, but rather construed in breadth and scope in accordance with the appended claims.

What is claimed is:

1. An inflatable decoration system comprising:

an inflatable bladder assembly comprising an inflatable bladder having an aperture for dispensing media into the bladder to inflate the bladder and also having a seal to at least partially seal the aperture to maintain the media within bladder, the inflatable bladder assembly further comprising a plurality of attachment assemblies fixed to the exterior of the bladder assembly;

at least one support rod to assist in maintaining the inflatable bladder in an upright position;

a light string assembly comprising two or more lamp systems connected by conductive wires, the light string assembly disposed outside the bladder and attached to the plurality of attachment assemblies fixed to the exterior of the bladder assembly;

a covering to cover a majority of the inflatable bladder assembly such that at least two lamp systems of the light string assembly are disposed between the inflatable bladder and the covering; and a stabilization member to secure the covering to the ground;

wherein the inflatable bladder can be inflated and deflated, and wherein the inflatable bladder is foldable when deflated.

2. The decoration system of claim 1, wherein the media is air and the aperture is designed to accept air from an air pump.

3. The decoration system of claim 1, wherein the media is air and the aperture is designed to accept air from a person blowing into a closeable tube.

4. The decoration system of claim 1, wherein the at least one support rod provides support to the bladder when the bladder is at least partially inflated.

5. The decoration system of claim 1, wherein the support rods are disposed internally to the bladder.

6. The decoration system of claim 1, wherein the support rods are removable.

7. The decoration system of claim 1, wherein the light string assembly comprises:

a light assembly comprising:

a light source;

a base; and a bypass activating system extending downwardly from the base;

a socket assembly dimensioned to receive via insertion at least a portion of the base of the light assembly;

a bypass mechanism positioned within the socket assembly comprising a conductive element having a pair of arms, wherein one or both of the arms of the conductive element are moveable between a first and second position;

wherein the bypass activating system causes one or both of the arms to move to a first position to cause current flow through the light assembly upon insertion of the bypass activating system into the socket assembly; and wherein upon removal of the bypass activating system from the socket assembly the current flow is bypassed around the light assembly and through the socket assembly.

8. The decoration system of claim 7, wherein the bypass activating system comprises at least one downwardly extending member.

9. The decoration system of claim 7, wherein the bypass mechanism comprises a holder and conductive element, wherein the holder comprises a cutout along its width adapted to receive and carry the conductive element therein, and wherein the conductive element comprises a pair of arms extending the length of the diameter of the socket.

10. The decoration system of claim 9, wherein the conductive element is a spring.

11. An inflatable decoration system comprising:

an inflatable bladder adapted to receive media within the bladder and having a seal to maintain the media within the bladder;

at least one removable support rod to assist in maintaining the inflatable bladder in an upright position;

a light string assembly disposed outside the bladder, the light string assembly comprising two or more lamp systems connected by conductive wires, and the light string assembly attached to the bladder at a plurality of locations, at least two lamp systems of the two or more lamp systems comprising a light source;

a covering to cover a majority of the inflatable bladder such that the two or more lamp systems of the light string assembly are disposed outside the bladder and inside the covering; and a tie down to secure the covering to the ground;

wherein the light string assembly is attached to the bladder by a plurality of attachment assemblies fixed to the exterior of the bladder assembly.

12. The decorative system of claim 11, wherein the covering is adapted to be placed over the inflatable bladder prior to the bladder receiving the media and after the bladder is at least partially inflated with the media.

13. The decorative system of claim 11, wherein the inflatable bladder is configured to be foldable when not inflated.

* * * * *